US007527258B2

(12) United States Patent
Ito

(10) Patent No.: US 7,527,258 B2
(45) Date of Patent: May 5, 2009

(54) PAPER FEED TRAY AND IMAGE FORMING APPARATUS INCLUDING THE SAME

(75) Inventor: Yoshiyuki Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 312 days.

(21) Appl. No.: 11/288,344

(22) Filed: Nov. 29, 2005

(65) Prior Publication Data

US 2006/0113725 A1 Jun. 1, 2006

(30) Foreign Application Priority Data

Nov. 30, 2004 (JP) ..... 2004-345911

(51) Int. Cl.
*B65H 1/00* (2006.01)

(52) U.S. Cl. ..... 271/171; 271/145

(58) Field of Classification Search ..... 271/145, 271/171

See application file for complete search history.

(56) References Cited

U.S. PATENT DOCUMENTS

| | | | | |
|---|---|---|---|---|
| 5,769,409 | A * | 6/1998 | Nakamatsu et al. | 271/171 |
| 6,409,165 | B1 * | 6/2002 | Yamaoka et al. | 271/145 |
| 6,916,019 | B2 * | 7/2005 | Takahashi | 271/145 |
| 6,926,267 | B2 * | 8/2005 | Kobayashi | 271/3.14 |
| 2004/0188924 | A1 * | 9/2004 | Ito | 271/171 |
| 2005/0121315 | A1 * | 6/2005 | Baltrucki et al. | 204/228.4 |

FOREIGN PATENT DOCUMENTS

| | | |
|---|---|---|
| JP | B2 07-53537 | 6/1995 |
| JP | A 10-231028 | 9/1998 |
| JP | A 2003-95447 | 4/2003 |
| JP | A 2003-182875 | 7/2003 |
| JP | A 2003-201021 | 7/2003 |

* cited by examiner

*Primary Examiner*—Kaitlin S Joerger
(74) *Attorney, Agent, or Firm*—Oliff & Berridge, PLC

(57) ABSTRACT

A paper feed tray includes: a case that accommodates a stack of paper; a slide member that is provided to be slidable with respect to the case in accordance with the size of the paper; a guide member that is supported by the slide member and is provided with a regulation surface regulating an end portion of the paper; and a movable member that is provided with at least a portion of the regulation surface and is provided to be movable with respect to the slide member, the movable member serving as a portion of the guide member. The movable member is supported to be movable with respect to the slide member so that the regulation surface of the movable member is separated from the end portion of the paper when setting the paper. The movable member is urged toward a position where the end portion of the paper is regulated.

21 Claims, 12 Drawing Sheets

PAPER FEED TRAY AND IMAGE FORMING APPARATUS INCLUDING THE SAME

CROSS REFERENCE TO RELATED APPLICATION

This application claims priority from Japanese Patent Application No. 2004-345911 filed on Nov. 30, 2004, the entire subject matter of which is incorporated herein by reference.

TECHNICAL FIELD

The present invention may relate to a paper feed tray having a regulation member that guides the end portion of a recording medium, and an image forming apparatus including the paper feed tray.

BACKGROUND

Conventionally, an image forming apparatus such as a copy machine, a laser printer, or the like, includes a paper feed tray that is detachably provided to accommodate a pile of papers. Generally, such a paper feed tray is provided with a pair of paper guides that slides in a paper width direction so as to regulate the movement in the direction (the paper width direction) orthogonal to a paper conveying direction. Further, a technique in which a paper can be precisely regulated by this type of paper guide is disclosed in JP-A-2003-201021.

A paper guide 80 disclosed in JP-A-2003-201021 is provided with a main guide member 81 and a vertical regulation guide member 82, as shown in FIGS. 12 and 13. The main guide member 81 is formed by integrally molding a main horizontal member 87 that receives a lower side surface of a paper and a side member 88 that is provided to be erected substantially vertically from the main horizontal member 87.

The vertical regulation guide member 82 is provided with a horizontal member 83 that receives a lower side surface of a paper and a vertical guide 84 that is erected from the horizontal member 83. In addition, a shaft 85 is provided to the connection portion between the horizontal member 83 and the vertical guide 84 so as to be swingably mounted on the connection portion between the main horizontal member 87 and the side member 88 of the main guide member 81. Further, on the lower surface of the horizontal member 83 of the vertical regulation guide member 82, a coil spring 86 is mounted, so that the vertical guide 84 is slightly urged so as to lean to the direction (a direction opposite to an arrow B) where the upper potion thereof is separated from the side end portion of a paper. With this structure, when papers are set to be stacked, the vertical guide 84 leans inside the side member 88 of the main guide member 81 so that the paper setting can be prevented from being obstructed.

However, the vertical guide 84 of the vertical regulation guide member 82 is urged by the coil spring 86 so as to lean to the direction where the vertical guide 84 is separated from the side end portion of a paper. Therefore, when the number of papers set in the paper guide 80 is small, the vertical guide 84 leans to the direction where the vertical guide 84 is separated from the end portion of paper. Accordingly, it is apprehended that a paper cannot be conveyed accurately and thus a paper jam occurs.

SUMMARY

One aspect of the present invention may provide a paper feed tray that reliably regulates an end portion of paper after setting the paper therein, and may prevent a guide member from obstructing the paper setting at the time of setting the paper.

A paper feed tray includes: a case that accommodates a stack of paper; a slide member that is provided to be slidable with respect to the case in accordance with the size of the paper; a guide member that is supported by the slide member and is provided with a regulation surface regulating an end portion of the paper; and a movable member that is provided with at least a portion of the regulation surface and is provided to be movable with respect to the slide member, the movable member serving as a portion of the guide member. The movable member is supported to be movable with respect to the slide member so that the regulation surface of the movable member is separated from the end portion of the paper when setting the paper. The movable member is urged toward a position where the end portion of the paper is regulated.

An image forming apparatus includes: a paper feed tray; a conveying unit that conveys a paper along a conveying path provided inside a housing of the image forming apparatus; and an image forming unit that is provided in the conveying path to form an image on the paper conveyed by the conveying unit. The paper feed tray includes: a case that accommodates a stack of paper; a slide member that is provided to be slidable with respect to the case in accordance with the size of the paper; a guide member that is supported by the slide member and is provided with a regulation surface regulating an end portion of the paper; and a movable member that is provided with at least a portion of the regulation surface and is provided to be movable with respect to the slide member, the movable member serving as a portion of the guide member. The movable member is supported to be movable with respect to the slide member so that the regulation surface of the movable member is separated from the end portion of the paper when setting the paper. The movable member is urged toward a position where the end portion of the paper is regulated.

DETAILED DESCRIPTION

Embodiments will be described below with reference to the drawings.

First Embodiment

Figure 1:
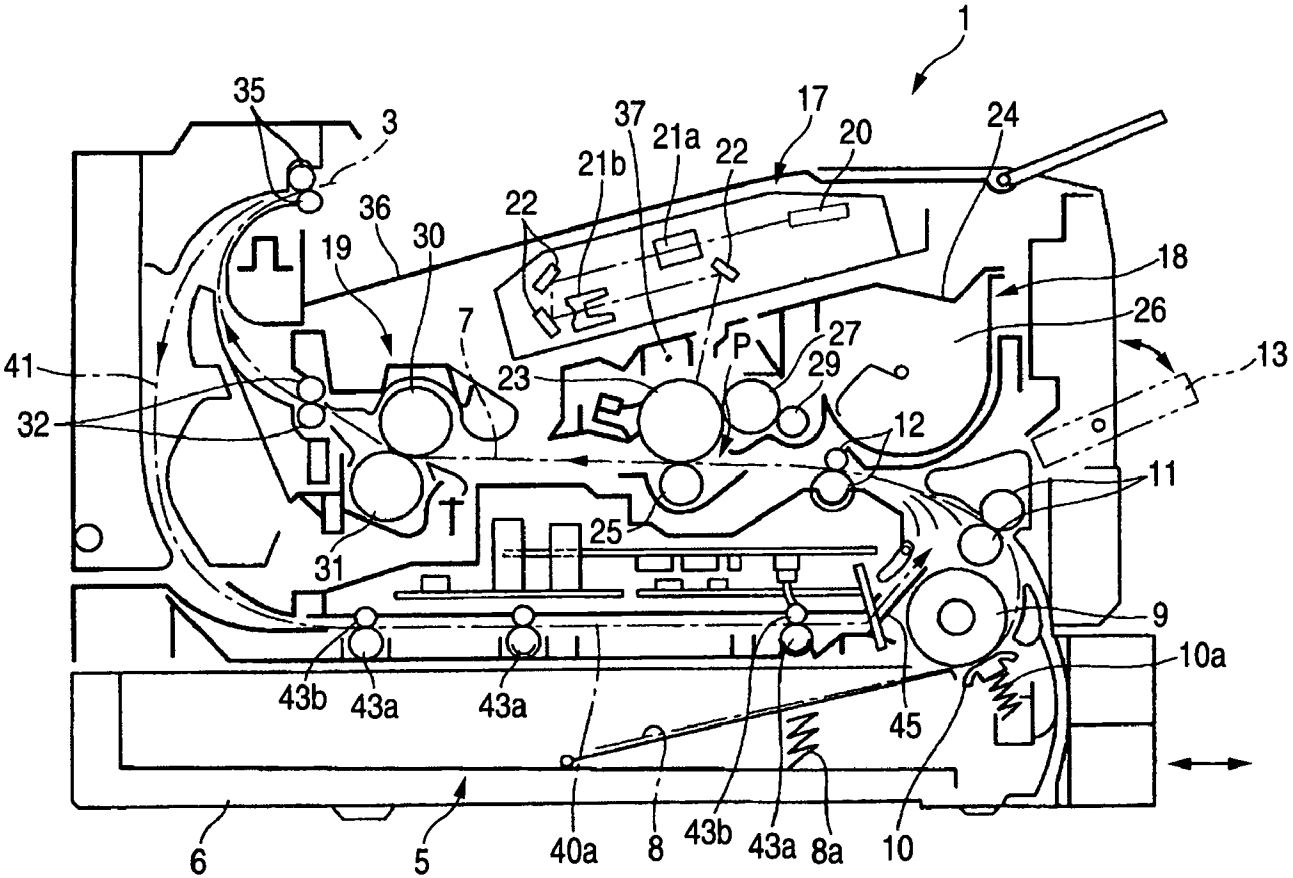
FIG. 1 is a cross-sectional view illustrating a laser printer according to an illustrative aspects of the invention.

First, an overall structure of a laser printer according to a first embodiment will be described with reference to FIG. 1. FIG. 1 is a cross-sectional view illustrating a laser printer according to an embodiment. The front side of the laser printer 1 is shown at right side of FIG. 1, and a back side of the laser printer is shown at left side of FIG. 1.

As shown in FIG. 1, in the lower portion of the laser printer 1, a paper feed unit 5 that feeds a paper 3 (cut sheet) serving as a recording medium is disposed. In addition, the laser printer 1 is provided with a process unit 18 that forms a predetermined image on the fed paper 3, a scanner unit 17, and a fixing device 19 that thermally fixes an image on the paper 3.

The paper feed unit 5 is provided with a paper feed tray 6 that is detachably mounted on a main body frame of the laser printer 1, a paper pressing plate 8 provided inside the paper feed tray 6, a half-moon-shaped paper feed roller 9 provided above one-side end portion of the paper feed tray 6, and a separation pad 10.

The paper 3 is stacked on the upper surface of the paper pressing plate 8, and the lower surface of the paper pressing plate 8 is urged upward by a spring 8*a*. As one end of the paper pressing plate 8 located at the far side with respect to the paper feed roller 9 is swingably supported, the other end thereof close to the paper feed roller 9 can move in the up and down direction. The paper feed roller 9 and the separation pad 10 are disposed to face each other. The separation pad 10 made of a member of which the friction resistance is high is pressed against the paper feed roller 9 by a spring 10*a* arranged at the rear side of the separation pad 10.

A conveying path 7 of paper 3 is configured along a path from the paper feed roller 9 to a pair of paper discharge rollers 35 via an image forming position P (the contact between a photo conductor drum 23 and a transfer roller 25, which will be described below, i.e. a transfer position where a toner image on the photo conductor drum 23 is transferred onto the paper 3) of the process unit 18, as indicated by a dashed line in the drawing. Between the paper feed roller 9 and the image forming position P, a pair of conveying rollers 11 and a pair of resist rollers 12 are sequentially disposed along the conveying path 7.

The paper 3 that is placed in the uppermost layer among the papers 3 stacked on the paper pressing plate 8 is pressed against the paper feed roller 9 and is interposed between the paper feed roller 9 and the separation pad 10 by the rotation of the paper feed roller 9. The papers 3 are sequentially sent one by one to the pair of conveying rollers 11 and the pair of resist rollers 12. The paper 3 is skew-corrected by the pair of resist rollers 12 as described below and is then sent to the image forming position P of the process unit 18.

At the front side of the main body, a manual tray 13 for manually feeding the paper 3 is mounted in the vicinity of the process unit so as to be open and closed.

The scanner unit 17 disposed above the process unit 18 is provided with a laser emitting unit (not shown), a polygon mirror 20 which is rotationally driven, lenses 21*a* and 21*b*, a reflecting mirror 22, and the like. A laser beam based on a predetermined image data emitted from the laser emitting unit is transmitted or reflected through the polygon mirror 20, the lens 21*a*, the reflecting mirror 22, and the lens 21*b* in this order so as to be irradiated by high-speed scanning on the surface of the photo conductor drum 23 serving as a photo conductor in the process unit 18.

The process unit 18 is provided with a drum cartridge having the photo conductor drum 23, a scorotron-type charger 37 serving as a charging means, and a transfer roller 25 serving as a transfer means and a developing cartridge 24 which is detachable to the drum cartridge. The developing cartridge 24 is provided with a toner containing portion 26, a developing roller 27, a thickness regulating blade (not shown), and a toner supply roller 29.

The toner containing portion 26 is filled with non-magnetic mono-component positive polymerization toner serving as developer, and the toner is supplied to the developing toner by a toner supply roller 29. The toner is positively friction-charged between the toner supply roller 29 and the developing roller 27. With the rotation of the developing roller 27, the toner supplied to the developing roller 27 is carried into the developing roller 27 as a thin layer having a certain thickness by the sliding contact with the thickness regulating blade. The rotating photo conductor drum 23 is disposed to oppose the developing roller 27, a drum main body is grounded, and the surface thereof is formed of a positively-charged photosensitive layer which is made of an organic photo conductor material such as polycarbonate.

The scorotron-type charger 37 serving as a charging means is arranged at a predetermined interval above the photo conductor drum 23 so as not to come into contact with the photo conductor drum 23. The scorotron-type charger 37 is a positive scorotron-type charger that generates corona discharge from a charging wire such as tungsten. Further, the scorotron-type charge 37 is configured to uniformly and positively charge the surface of the photo conductor drum 23.

After the surface of the photo conductor drum 23 is uniformly and positively charged by the scorotron-type charger 37 with the rotation thereof, the surface is exposed by high-speed scanning of laser beam from the scanner unit 17 so that an electrostatic latent image based on a predetermined image data is formed. Further, when coming into contact with the photo conductor drum 23 opposed thereto, the toner which is carried on the developing roller 27 and positively charged by the rotation of the developing roller 27 is supplied to an electrostatic latent image which is formed on the surface of the photo conductor drum 23, that is, an exposed portion, which is exposed by a laser beam so that an electric potential thereof falls down, on the surface of the photo conductor drum 23 which is uniformly and positively charged. Then, the toner is selectively carried, so that a toner image which is a visual image is formed.

The transfer roller 25 is disposed to oppose the photo conductor drum 23 in the lower side of the photo conductor drum 23. The transfer roller 25, in which a roller shaft made of metal is coated with a roller made of an ion conductive rubber material, is configured so that a transfer bias (transfer forward bias) is applied from a transfer bias applying power source at the time of transfer. Therefore, the toner image carried on the surface of the photo conductor drum 23 is transferred onto the paper 3 when the paper 3 passes between the photo conductor drum 23 and the transfer roller 25.

The fixing device 19, which is disposed in the downstream side along the conveying path 7 from the process unit 18, is provided with one heating roller 30, a pressing roller 31 which is provided to press the heating roller 30, and a pair of conveying rollers 32 provided in the downstream of the above rollers. The heating roller 30, provided with a heater such as a halogen lamp for heating which is made of metal such as aluminum, thermally fixes the toner transferred onto the paper 3 in the process unit 18 while the paper 3 passes between the heating roller 30 and the pressing roller 31. After that, the paper 3 is conveyed to the position of the pair of paper discharge rollers 35 by the pair of conveying rollers 32. The printed paper 3 is discharged onto the discharge tray 36 by the rotation of the pair of discharge rollers 35.

The laser printer 1 according to the present embodiment supports double-side printing of paper 3. Therefore, it is selected whether the paper 3 conveyed to the pair of discharge rollers 35 is discharged as described above or single-side printing with respect to the paper 3 is performed once again.

Here, the double-side printing performed by the laser printer 1 will be described. When the double-side printing is set, the paper 3 conveyed to the pair of discharge rollers 35 after single-side printing is again conveyed toward the pair of resist rollers 12 along an inverting path 41 and a reconveying path 40*a* continuing into the inverting path 41, in a state where the front and back sides are inverted by the reverse rotation of the pair of the discharge rollers 35. In the reconveying path 40*a*, the paper 3 is conveyed while being interposed between plural pairs of reconveying rollers 43*a* and 43*b* and is again conveyed to the pair of resist rollers 12 through a reconveying guide 45, so that printing is performed on the other non-printed surface by the process unit 18. The paper after double-side printing is discharged onto the discharge tray 36 by the rotation of the discharge roller 35, as described above.

Figure 2:
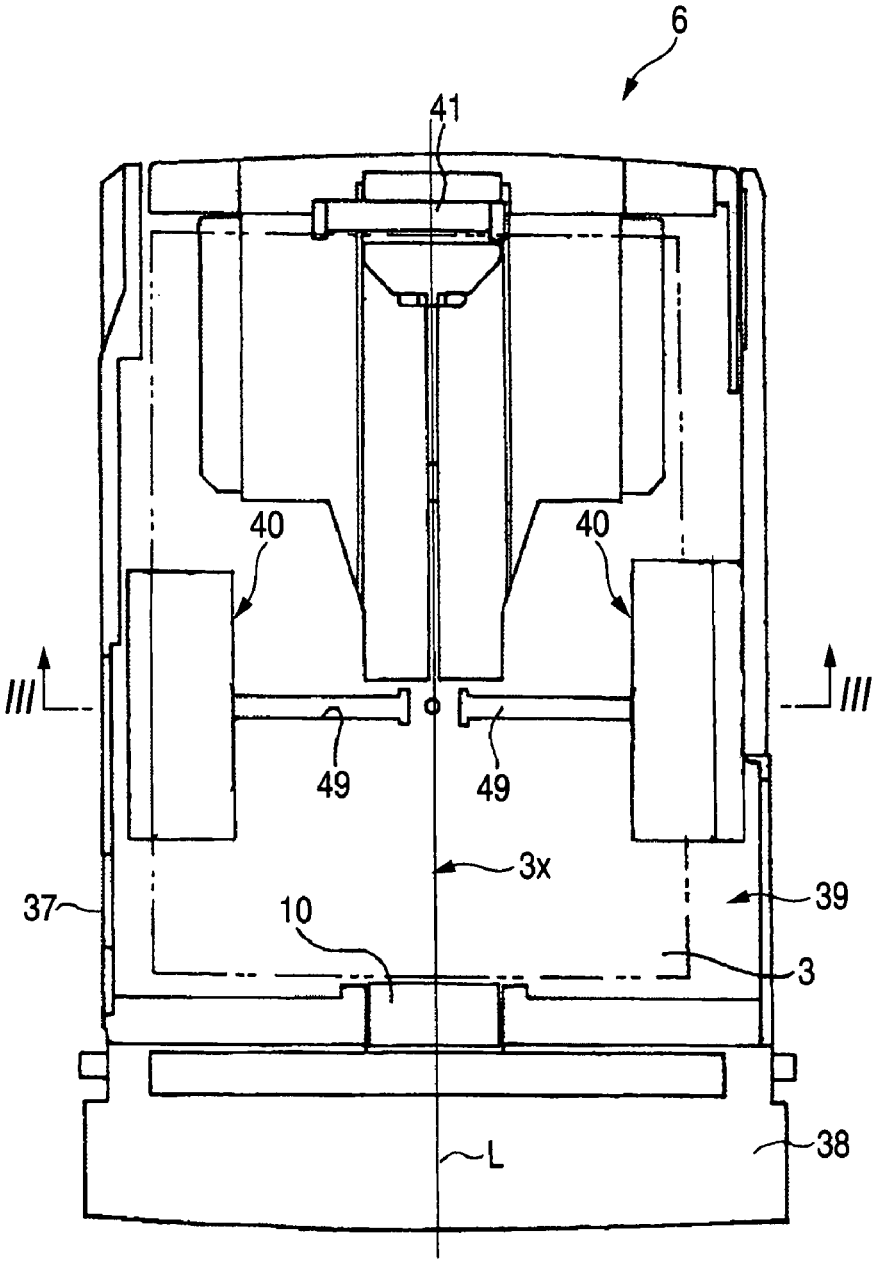
FIG. 2 is a plan view illustrating a paper feed tray according to an illustrative aspects of the invention.

Next, referring to FIG. 2, an overall structure of the paper feed tray 6 that is detachably provided at the lower side of the laser printer 1 will be described. FIG. 2 is a plan view illustrating the paper feed tray.

The paper feed tray 6 according to the embodiment, which can set a plurality of papers 3 having different sizes on the basis of a center reference, is provided with a case 37 for stacking the papers 3, and a handle portion 38.

A bottom surface 39 of the case 37, which is rectangular, is formed as a whole in a box shape where the upper side is open. In addition, the case 37 is composed of a pair of side guides 40 serving as guide members regulating the paper-width direction from both sides, an end guide 41 serving as a guide portion regulating the longitudinal direction of the paper 3 from the back side, and the separation pad 10 and the paper pressing plate 8 which supply the papers 3 one by one as described above.

As shown in FIG. 2, the handle portion 38 is provided on the front side of the paper feed tray, and a user grasps the handle portion 38 to move the paper feed tray 6 back and forth with respect to the main body of the laser printer 1, so that the paper feed tray 6 is attached and removed.

The end guide 41 is disposed inside the case 37 so as to be opposite to the handle portion 38 and can move in the longitudinal direction of the paper 3. The pair of side guides 40 is disposed to interpose the central reference line L therebetween and to be movable in the paper width direction. The side guides 40 will be described in detail afterward.

Moreover, as shown in FIG. 2, a region, which is substantially rectangular in plan view and is surrounded by the surfaces facing each other in the separation pad 10 and the end guide 41 and the surfaces facing each other in the pair of side guides 40, is a paper holding region 3*x* for stacking and holding the papers 3. As described above, by moving the end guide 41 and the pair of side guides 40, the size of the paper holding region 3*x* can be changed in accordance with the size of the paper 3 to be set.

Figure 3:
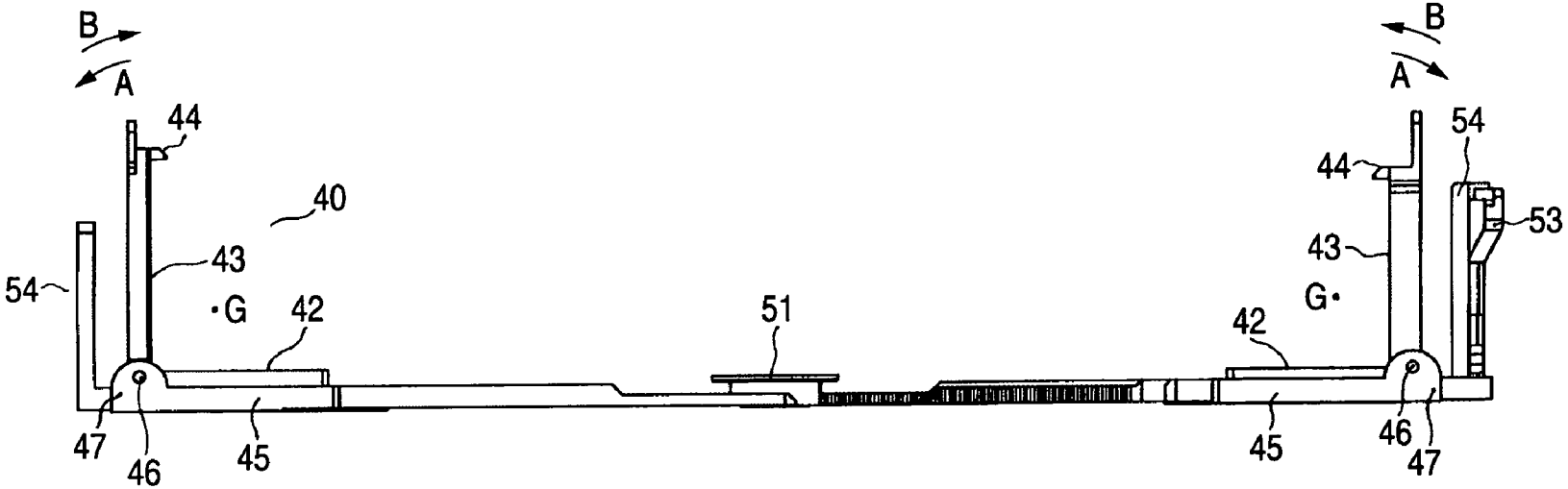
FIG. 3 is a cross-sectional view of a side guide taken along a III-III line shown in FIG. 2, according to a first illustrative aspects of the invention.
Figure 4:
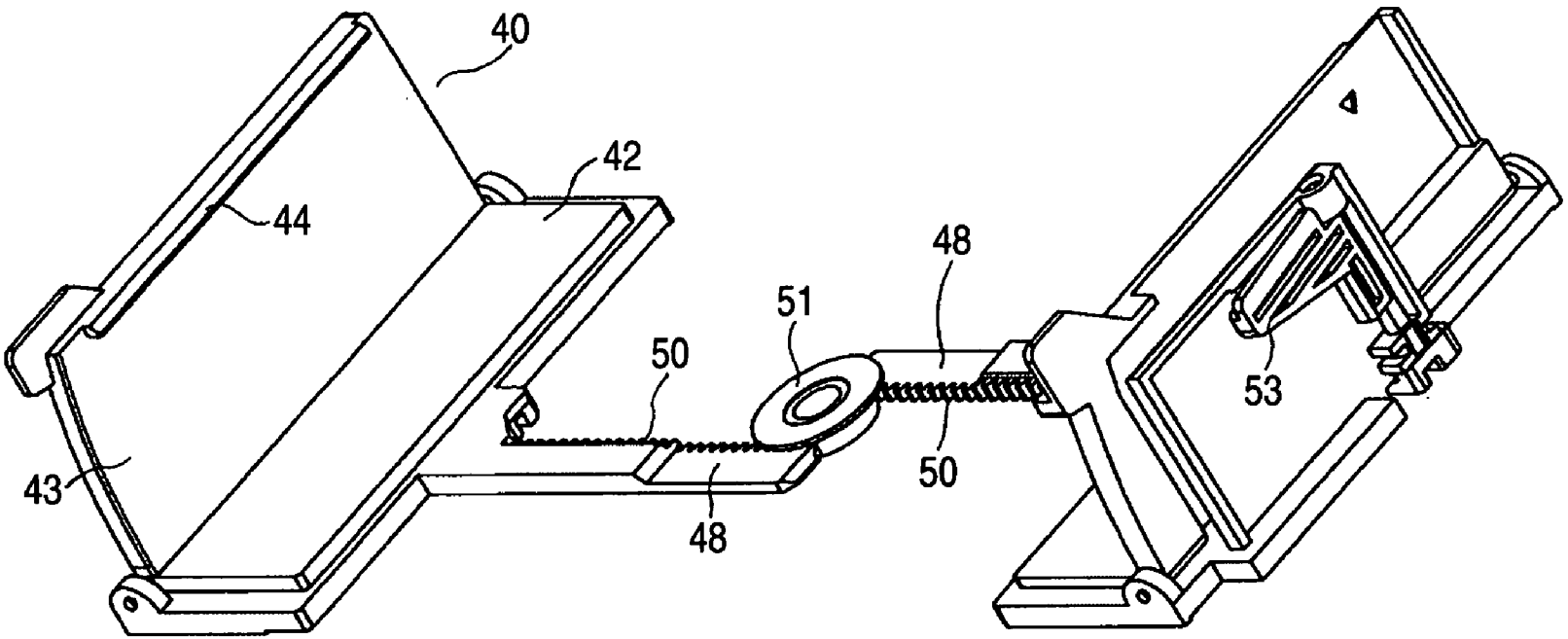
FIG. 4 is a perspective view illustrating the side guide according to the first illustrative aspects of the invention, seen from above.
Figure 5:
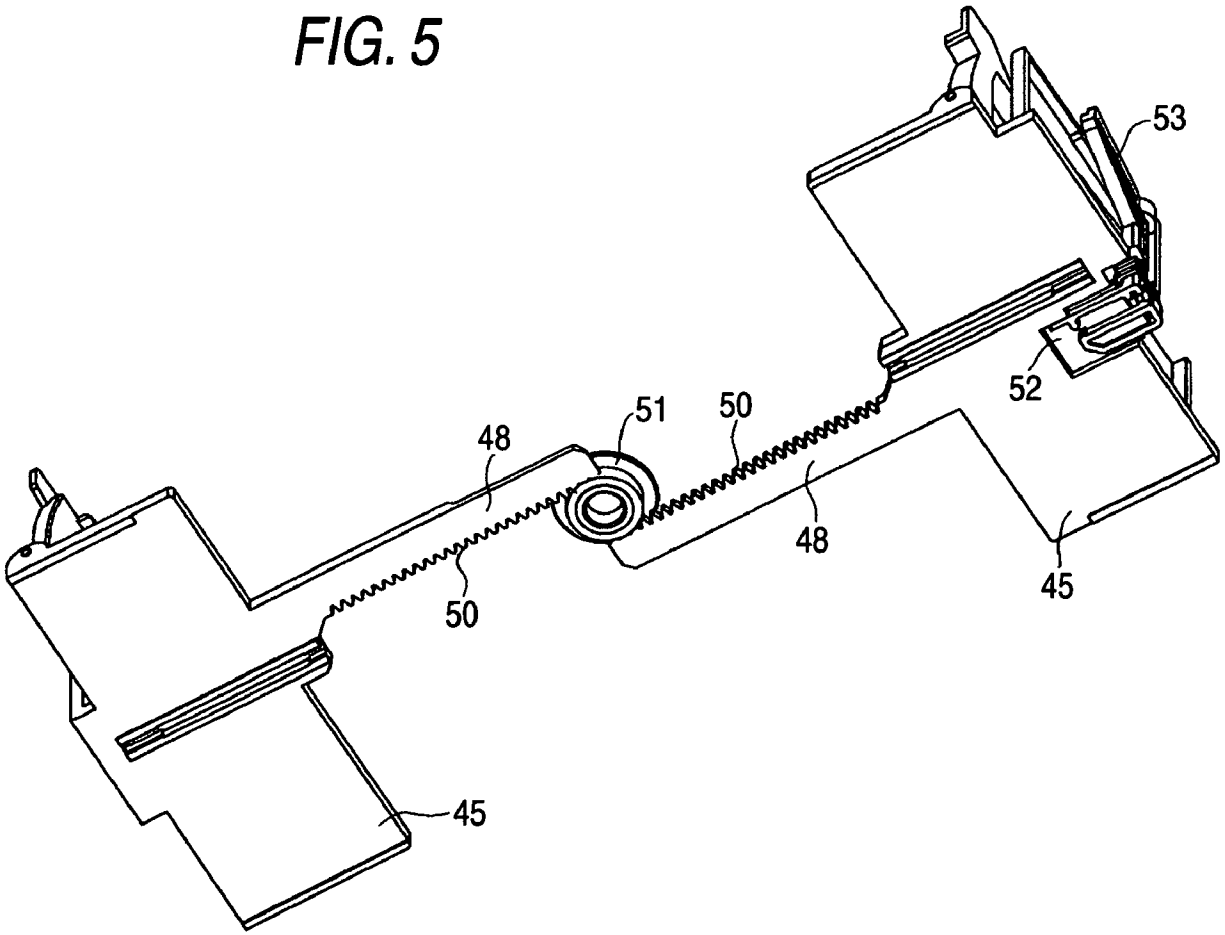
FIG. 5 is a perspective view illustrating the side guide according to the first illustrative aspects of the invention, seen from below.

Next, the side guide 40 that serves as a movable member and a guide member will be described in detail with reference to FIGS. 2 to 5. FIG. 3 is a cross-sectional view of the paper feed tray 6 taken along the III-III line shown in FIG. 2. FIG. 4 is a perspective view illustrating the side guide, seen from above. FIG. 5 is a perspective view illustrating the side guide, seen from below.

The pair of side guides 40 facing each other is composed of a bottom portion 42 on which the paper 3 is stacked and a regulation section 43 which is erected vertically with respect to the bottom portion 42.

The regulation section 43 of the side guide 40 has a rectangular plane and is provided with a protruding portion 44 on the upper end thereof.

The protruding portion 44 protrudes in a wedge shape in the direction, where the side guides 40 faces each other, from the upper end of the regulation section 43. In addition, the surface of the protruding portion 44 opposite to the bottom portion 42, that is, the surface facing downward is horizontal with respect to the bottom portion 42.

The bottom portion 42 has a rectangular plane and is provided with a rotating shaft 46 in a portion connected with the regulation portion 43. By the rotating shaft 46, the side guide 40 is swingably attached to a slide member 45 to be described below.

The pair of slide members 45 is provided below the side guides 40. Each of the slide members 45 has a rectangular plane and also has a bearing 47 so as to hold the rotating shaft 46 of the side guide 40 to be rotatable as shown in the drawing.

On one end of the slide member 45, a rack member 48 is provided.

In addition, on the other end of one of the pair of slide members 45, a lock claw 52 is provided at the lower side thereof and a knob 53 for operating the lock claw 52 is provided at the upper side thereof. In addition, between the regulation portion 43 and the knob 53, a stopper 54 is provided to regulate the rotation of the side guide 40. On the other end of the other slide member 45, a stopper 54 is also provided.

Further, on the lower surface of the slide member 45, a slide portion (not shown) is provided, which is fitted into a slide hole 49 formed long and narrowly along the paper-width direction on the bottom surface 39 of the paper feed tray 6.

The rack member 48 is provided so as to extend toward the center line L from the slide member 45. On the pair of rack members 48, rack gears 50 are provided to face each other and are geared into a pinion 51 which is pivotably mounted on the center line L of the bottom surface 39. With this structure, if one of the side guides 40 slides, the other one also slides to move in the opposite direction by the same distance.

The lock claw 52 and the knob 53, which are integrally formed of synthetic resin or the like, are rotatably mounted on the slide member 45.

The lock claw 52 is fitted into a lock portion (not shown), which is provided corresponding to a paper size on the bottom surface 39, so as to fix the slide member 45 to a predetermined paper size position.

The lock claw 52 is formed so as to be urged in the direction where it is fitted into the lock portion (not shown). Further, if a user rotates the knob 53 toward the stopper, the position of the lock claw 52 is also changed in accordance with the rotation, so that the fitting into the lock portion (not shown) is released.

At this time, by moving the slide member 45 with respect to the case 37 and by fitting the lock claw 52 into another lock portion (not shown), it is possible to fix the slide member 45 to another paper size position.

With the above-described structure, when the end of the paper is abutted on the protruding portion 44 from the upper side, the side guide 40 is rotated outside (A direction), so that the side guide is not obstructive to the paper setting. Further, without user's direct operation, the side guide moves so as not to be obstructive to the paper setting, so that the paper setting is easily performed.

The side guide 40 is formed such that the cross section taken along the III-III line has an L-lettered shape formed by the bottom portion 42 and the regulation portion 43. Accordingly, the respective centers G of the side guides 40 are positioned below the upper end of the regulation portion 43 and in the direction where the side guides 40 oppose each other from the regulation portion 43. In the side guide 40, a force rotating in the arrow B direction acts due to an empty weight. In other words, since the side guide is urged toward the position where the paper is regulated, the regulation surface can be prevented from being separated from the end of the paper after the paper is set. Further, since the side guide is formed so that the cross section taken along the III-III line is L-lettered shape, the end of the paper can be regulated by a surface which is absolutely vertical with respect to the lower surface of the paper.

Since the surface of the protruding portion 44 opposite to the bottom portion 42, that is, the surface facing downward is horizontal with respect to the bottom portion 42, the upward movement of the paper after the paper setting can be regulated efficiently.

An operation when the paper 3 is set into the side guide 40 will be described.

First, the side guides 40 are moved to the position, where the interval between the regulation portions 43 corresponds to the paper width, through the slide members 45, and the lock claw 52 is fixed to the lock portion (not shown).

Next, when the paper 3 is pushed through between the side guides 40 while the end portion of the paper is abutted on the protruding portion 44 located at the upper end of the side guide, the side guide 40 is turned outside (direction shown by the arrows A in FIG. 3). Further, when the paper 3 is pushed through, the abutment between the protruding portion 44 and the end portion of the paper is released, and the side guide 40 is turned inside (direction shown by the arrows B in FIG. 3).

After that, due to the empty weight of the side guide 40, the side guide 40 is rotated while aligning the end portion of the paper, until the regulation section 43 becomes vertical with respect to the bottom surface 39. Thereby, the setting of the paper is completed.

Second Embodiment

Figure 6:
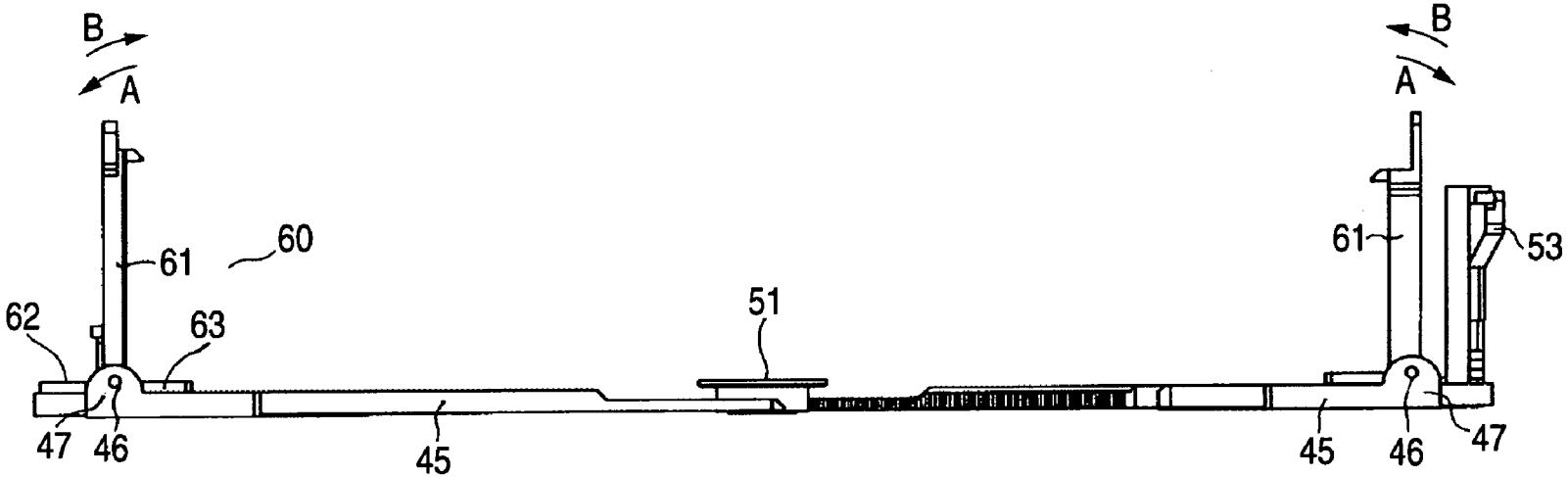
FIG. 6 is a cross-sectional view of a side guide taken along the III-III line shown in FIG. 2, according to a second illustrative aspects of the invention.
Figure 7:
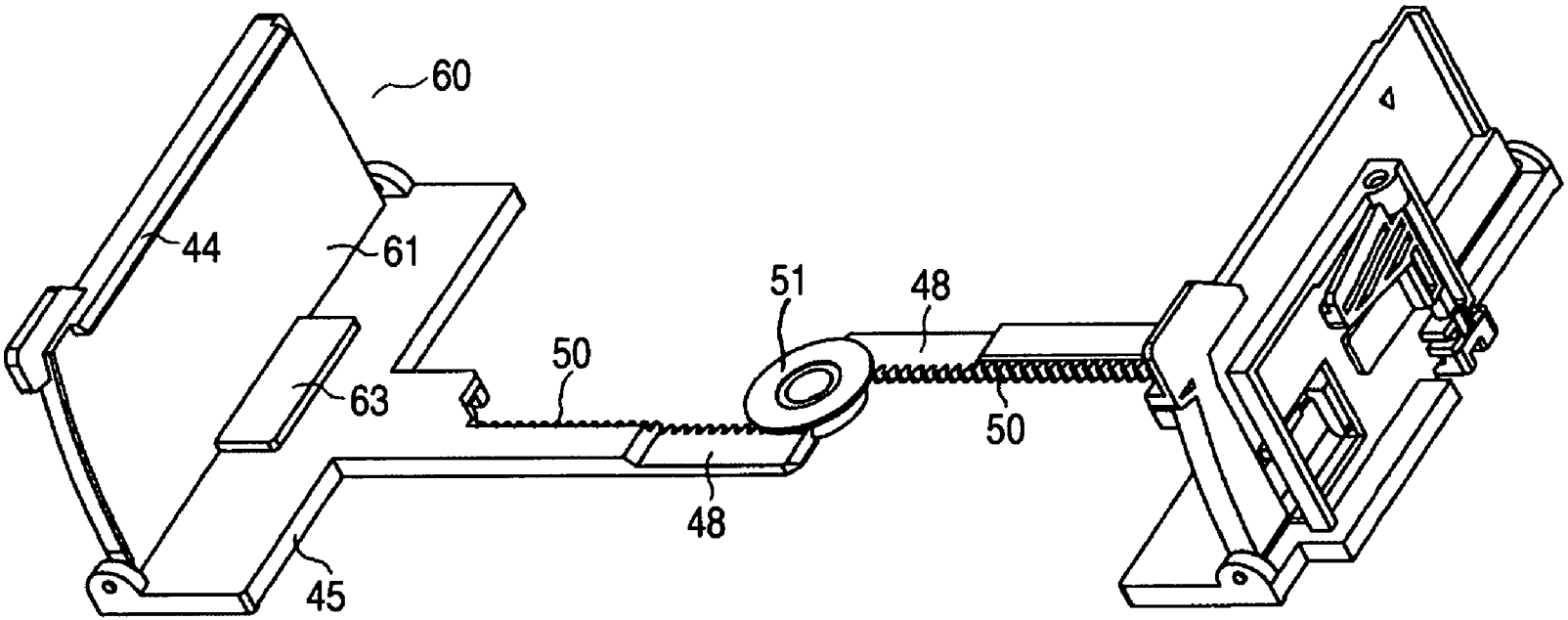
FIG. 7 is a perspective view illustrating the side guide according to the second illustrative aspects of the invention, seen from above.

In a second embodiment, a side guide 60 serving as a movable member and a guide member will be described, and FIGS. 2, 6, and 7 will be also described. In addition, except for components to be described below in the second embodiment, other components are the same as those of the first embodiment. FIG. 6 is a cross-sectional view of the paper feed tray 6 taken along the III-III line shown in FIG. 2. FIG. 7 is a perspective view illustrating the side guide, seen from above.

Each of the pair of side guides 60 facing each other is composed of a vertical regulation portion 61 that regulates an end portion of paper, a protruding portion 44 provided on the upper end, a rotating shaft 46 by which the side guide 60 is rotatably mounted on a slide member 45 to be described below.

The slide member 45 is provided with a shaft bearing 47 that holds the rotating shaft 46 to be rotatable.

As shown in the drawings, the vertical regulation portion 61 having a rectangular plane is urged from the surface opposite to the surface regulating the end portion of paper by a urging member such as a plate spring 62 so as to be erected with respect to the slide plate 45. In other words, the side guide 60 is urged toward the position where the paper is regulated, so that the regulation surface can be prevented from being separated from the end portion of paper after the paper setting.

In addition, the vertical regulation portion 61 is provided with an assisting member 63 for preventing the vertical regulation portion 61 from leaning in the directions shown by the arrows B in FIG. 6.

With the above-described structure, when the end portion of paper is abutted on the protruding portion 44 from the upper side, the side guide 60 rotates in the directions shown by the arrows A in FIG. 6 so as not to be obstructive to the paper setting.

Further, without user's direct operation, the side guide 60 moves so as not to be obstructive to the paper setting, so that the paper setting is easily performed.

An operation when the paper 3 is set into the side guide 60 will be described.

First, the side guides 60 are moved to the position, where the interval between the vertical regulation portions 61 corresponds to the paper width, through the slide members 45, and the lock claw 52 is fitted into a lock portion (not shown).

Next, the paper 3 is pushed through between the side guides 60, while the end portion of paper is abutted on the protruding portion 44 in the upper end of the vertical regulation section 61. Then, the side guides 60 are rotated outside (directions shown by the arrows A in FIG. 6). Further, if the paper 3 is pushed through, the abutment between the protruding portion 44 and the end portion of paper is released, and the vertical regulation portion 61 is rotated by the urging force of the plate spring 62 while aligning the end portion paper, until the vertical regulation portion 61 becomes vertical with respect to the bottom surface 39. At this point of time, the paper setting is completed.

Third Embodiment

Figure 8:
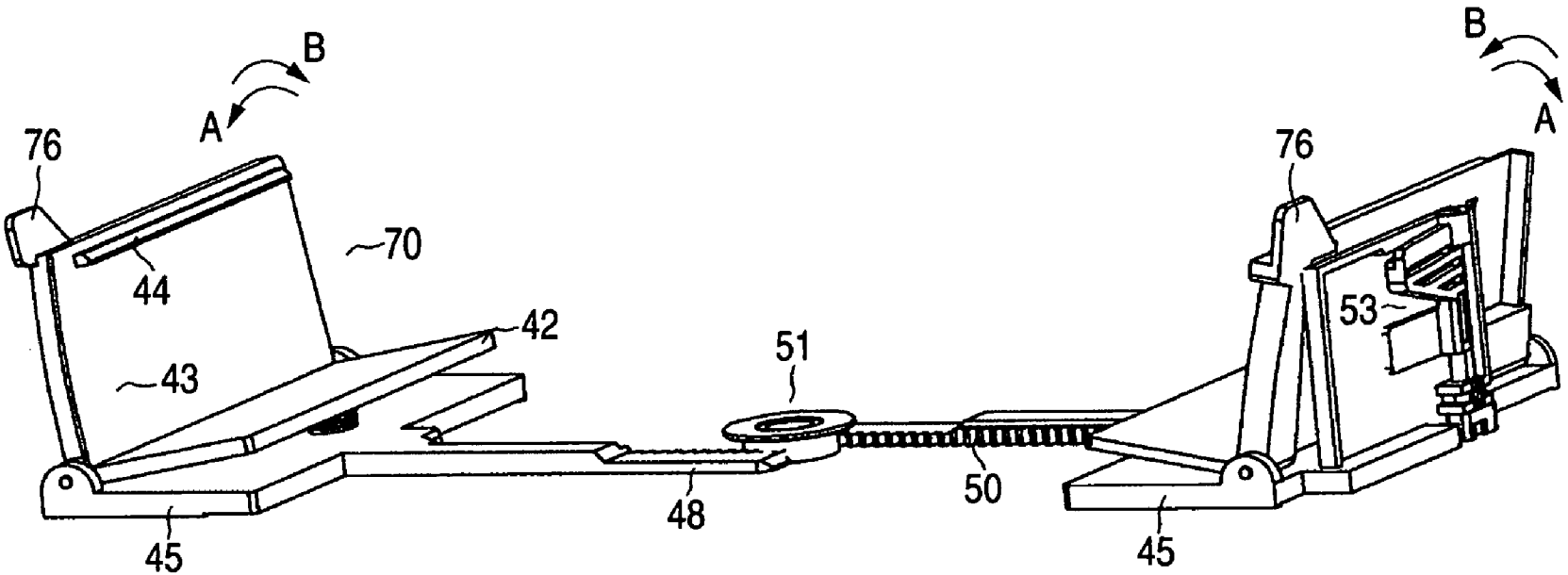
FIG. 8 is a perspective view illustrating a side guide according to a third illustrative aspects of the invention.
Figure 9:
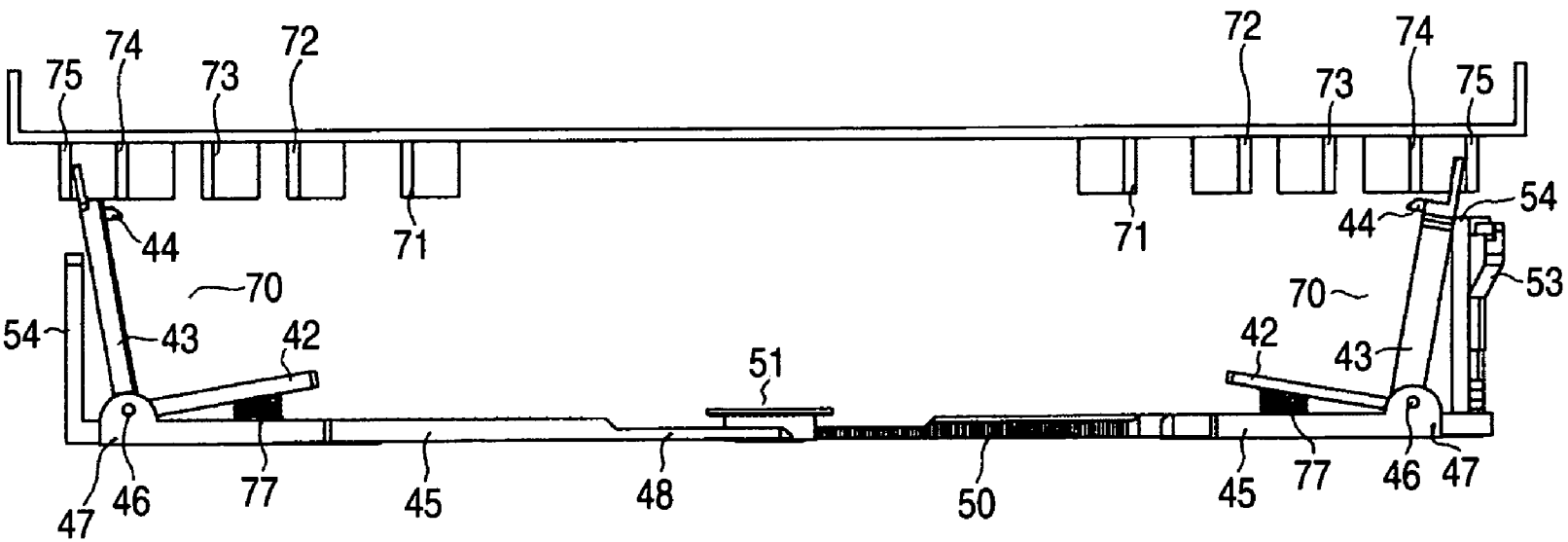
FIG. 9 is a cross-sectional view of the side guide taken along the III-III line shown in FIG. 2, according to the third illustrative aspects of the invention.
Figure 10:
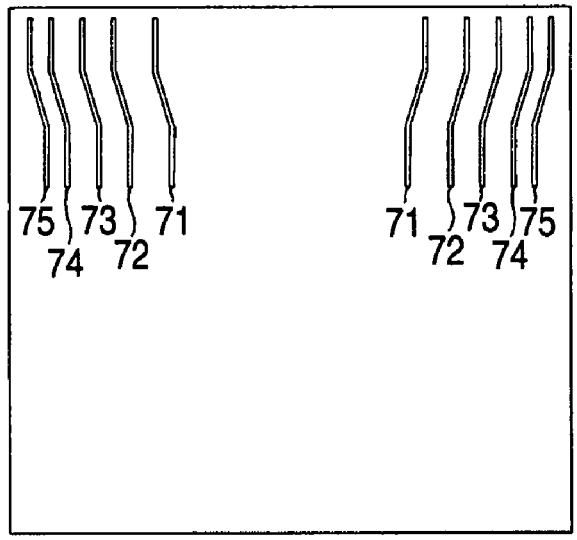
FIG. 10 is a plan view illustrating ribs on the upper surface of a main body frame according to the third illustrative aspects of the invention.
Figure 11:
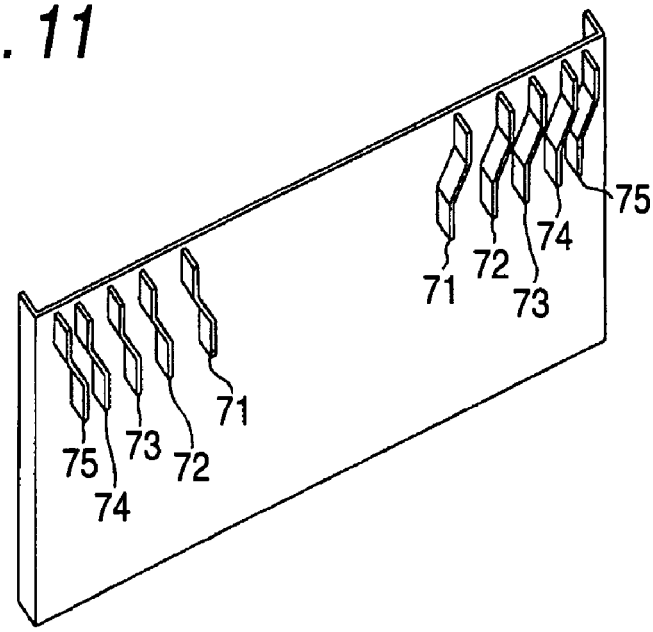
FIG. 11 is a perspective view illustrating ribs on the upper surface of the main body frame according to the third illustrative aspects of the invention.
Figure 12:
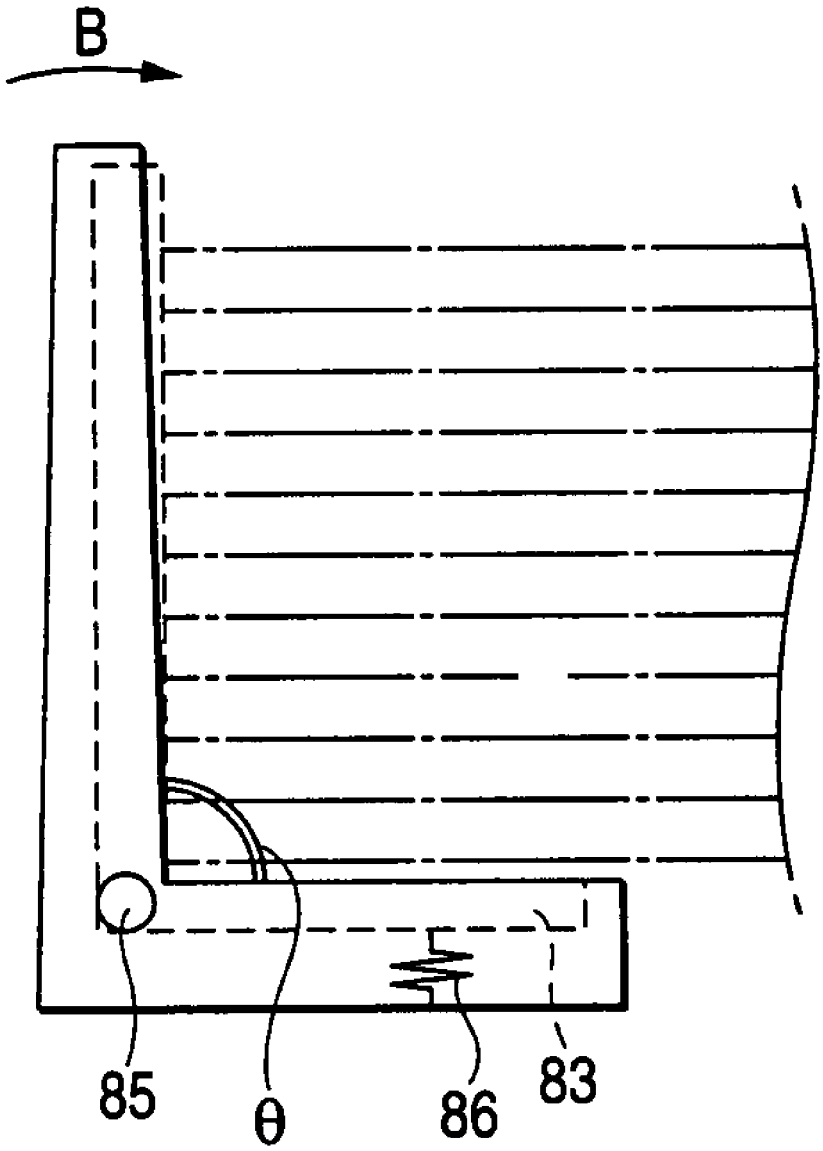
FIG. 12 is a plan view illustrating a side guide according to a conventional sheet feed tray.
Figure 13:
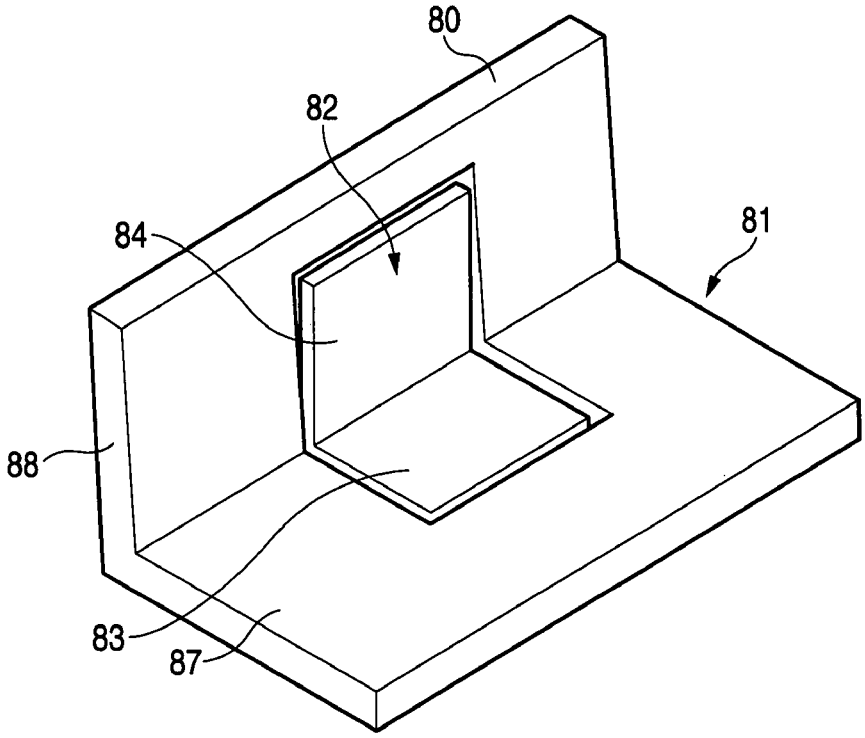
FIG. 13 is a perspective view illustrating the side guide according to the conventional sheet feed tray.

In a third embodiment, a side guide 70 will be described, and FIGS. 8 to 11 will be described. Further, except for components to be described below in the third embodiment, other components are the same as those of the first embodiment. FIG. 8 is a perspective view illustrating the side guide. FIG. 9 is a cross-sectional view of the side guide taken along the III-III line. FIG. 10 is a plan view illustrating ribs on a main body frame. FIG. 11 is a perspective view illustrating the ribs on the main body frame.

Each of the pair of side guides 70 facing each other is composed of a bottom portion 42 on which the paper 3 is stacked and a regulation portion 43 which is erected vertically with respect to the bottom portion 42.

The regulation portion 43 of the side guide 70 has a rectangular plane and is provided with a protruding portion 44 on the upper end thereof. Further, in a portion of the upper end of the regulation portion 43, a guided member 76 is provided, which is abutted on main body ribs 71 to 75 serving as guiding members to be described below, when the paper feed tray 6 is set in the main body.

The bottom portion 42 of the side guide 70 has a rectangular plane, and a rotating shaft is provided in a portion connected with the regulation section 43 so that the side guide 70 is swingably mounted on the slide member 45 to be described below. In addition, one end of a compression spring 77 serving as an opening mechanism is abutted on the lower surface of the bottom portion 42 so that the bottom portion 42 is urged upward.

Each of the slide members 45, provided in the lower side of the side guide 70, has a rectangular plane and a bearing 47 so as to hold the rotating shaft 46 of the side guide 70 to be rotatable. On the upper surface of the slide member 45, the other end of the compression spring 77 is supported.

In a housing portion of the paper feed tray 6 of the main body of an image forming apparatus, five pairs of reel-shaped ribs 72 to 75 serving as guided members are provided corresponding to the respective paper sizes above the bottom portion 42 of the side guide 70 and on the surface opposite to the bottom portion 42 when the paper feed tray 6 is accommodated.

From the opening portion side of the main body to the inside of the main body, the ribs 71 to 75 are bent in a staged manner toward the direction where the ribs face each other.

With the above-described structure, the side guide 70 is moved by the compression spring 77 so as not to be obstructive to the paper setting, without user's direct operation. Therefore, an operation of the paper setting is easily performed.

As the paper feed tray 6 is accommodated into the main body of the image forming apparatus, the side guide 70 is guided to the position, where the paper is regulated, by any one of the ribs 71 to 75 through the guided member 76 so as to be held in the position. Therefore, the side guide 70 can be prevented from being separated from the end portion of paper.

An operation when the paper 3 is set into the side guide 70 will be described.

First, the side guide 70 is moved to the position corresponding to the paper size so that the lock claw 52 and a lock portion (not shown) are fitted into each other.

Next, when the paper 3 is put on the bottom portion 42 between the side guides 70, the side guide 70 swings in the direction A.

When the number of papers is small, the side guide 70 leans to the direction A from the position, where the paper 3 is regulated, due to the urging force of the compression spring 77.

Subsequently, if the paper feed tray 6 is accommodated into the main body frame (not shown), the guided member 76 is accordingly abutted on the ribs 71 to 75, so that the side guide 70 is guided to a predetermined position where the paper is regulated. Thereby, the setting of paper 3 is completed.

As described above, the preferred embodiments of the invention have been described. However, the present invention is not limited to the above-described embodiments, but various modifications and changes can be made within the scope and sprit of the invention.

For example, the protruding portion 44 may be formed so that the cross section taken along the III-III line is semicircular. In addition, when the end portion of paper is abutted on the protruding portion from the upper side, it is preferable that the side guide be formed in a shape where it seems to smoothly rotate in the direction where the protruding portion is separated from the end portion of paper.

In the second embodiment, in a case where the elastic force of the plate spring 62 is sufficiently strong, the assisting member 63 is not indispensable.

In the above-described embodiments, the pair of side guides are provided to be rotatable with respect to the slide member, however, only one of the side guides may be rotatable.

In the above-described embodiments, as a paper guide, the side guide has been described, which regulates the end portion along the conveying direction of the paper 3. However, the paper guide can be applied to the end guide regulating the end portion which is vertical with respect to the conveying direction of the paper 3.

In the above-described embodiments, the side guide is set on the basis of a center reference. However, a side guide on the basis of a single side reference can be applied.

A member regulating the end portion of paper may be a plate-shaped elastic body.

The paper guide according to the present invention is not limited to a paper feed tray of a laser printer, but the paper guide can be applied to an inkjet printer, a copy machine, a facsimile, and the like.

The paper guide according to the present invention is not limited to only a paper feed tray detachable to an image forming apparatus but can be applied to a manual tray or the like.

The foregoing description of the embodiments has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A paper feed tray comprising:

a case that accommodates a stack of paper;

a slide member that is provided to be slidable with respect to the case in accordance with the size of the paper;

a guide member that is supported by the slide member and is provided with a regulation surface regulating an edge portion of the paper; and a movable member that is provided with at least a portion of the regulation surface and is provided to be movable with respect to the slide member, the movable member serving as a portion of the guide member, wherein the movable member is supported to be movable with respect to the slide member so that the regulation surface of the movable member is separated from the edge portion of the paper when setting the paper, wherein the movable member is urged toward a position, where the edge portion of the paper is regulated by contacting the regulation surface of the movable member, and wherein the movable member is structured to be swingable with respect to the slide member such that the movable member is rotatable outside of a position obstructive to a paper setting.

2. The paper feed tray according to claim 1, further comprising an urging member that urges the movable member toward the position where the edge portion of the paper is regulated.

3. The paper feed tray according to claim 1, wherein the movable member is urged toward the position where the edge portion of the paper is regulated due to the empty weight of the urging member.

4. The paper feed tray according to claim 1, wherein the movable member includes:

a bottom portion that supports a lower surface of the paper;

a regulation portion that is erected from the bottom portion; and a rotating shaft that supports a connection portion where the bottom portion and the regulation portion is connected to be rotatable, and wherein the slide member is provided with a bearing that holds the rotating shaft to be rotatable.

5. The paper feed tray according to claim 4, wherein the regulation portion is erected vertically on the bottom portion.

6. The paper feed tray according to claim 1 wherein the movable member includes:

a vertical regulation portion that abuts on the edge portion of the paper; and a rotating shaft that swingably supports one end of the vertical regulation portion, and wherein the slide member includes:

a bearing that supports the rotating shaft to be rotatable; and an urging member that urges the vertical regulation portion with respect to the slide member in a direction in which the vertical regulation portion is erected.

7. The paper feed tray according to claim 1, wherein the movable member is provided with a protruding portion that protrudes in a direction in which the movable member abuts on the edge portion of the paper, and wherein the protruding portion is positioned above the paper after setting the paper.

8. The paper feed tray according to claim 7, wherein an amount of protrusion of the protruding portion in the direction in which the protruding portion abuts on the edge portion of the paper increases downward up to a predetermined position.

9. The paper feed tray according to claim 8, wherein the amount of the protrusion of the protruding portion increases with a first change rate downward up to a predetermined position, wherein the amount of protrusion decreases with a second change rate that is higher than the first change rate downward from the predetermined position, and wherein the amount of protrusion becomes substantially zero when the protruding portion is positioned at a downmost position.

10. The paper feed tray according to claim 1, further comprising a stopper provided in at least one of the guide member and the slide member, the stopper regulating an amount of movement of the guide member with respect to the slide member.

11. A paper feed tray comprising:

a case that accommodates a stack of paper;

a slide member that is provided to be slidable with respect to the case in accordance with the size of the paper;

a guide member that is supported by the slide member and is provided with a regulation surface regulating an edge portion of the paper; and a movable member that is provided with at least a portion of the regulation surface and is provided to be movable with respect to the slide member, the movable member serving as a portion of the guide member, wherein the movable member includes:

a bottom portion that supports a lower surface of the paper;

a regulation portion that is erected from the bottom portion;

an opening mechanism that urges the regulation portion so as to be separated from the edge portion of the paper; and a guided member, and wherein the guided member abuts on a guiding member to guide the movable member to the position, where the paper is regulated by contacting the regulation surface of the movable member, when the case is accommodated in a main body of an image forming apparatus in which the guiding member is provided at the position corresponding to the guided member in a housing portion of the case, wherein the movable member is structured to be swingable with respect to the slide member such that the movable member is rotatable outside of a position obstructive to a paper setting.

12. The paper feed tray according to claim 11 wherein the movable member further includes a rotating shaft that supports a connection portion where the bottom portion and the regulation portion is connected to be rotatable, and wherein the slide member is provided with a bearing that holds the rotating shaft to be rotatable.

13. The paper feed tray according to claim 11, wherein the regulation portion is erected vertically on the bottom portion.

14. The paper feed tray according to claim 11 wherein the movable member includes:

a vertical regulation portion that abuts on the edge portion of the paper; and a rotating shaft that swingably supports one end of the vertical regulation portion, and wherein the slide member includes:

a bearing that supports the rotating shaft to be rotatable; and an urging member that urges the vertical regulation portion with respect to the slide member in a direction in which the vertical regulation portion is erected.

15. The paper feed tray according to claim 11, wherein the movable member is provided with a protruding portion that protrudes in a direction in which the movable member abuts on the edge portion of the paper, and wherein the protruding portion is positioned above the paper after setting the paper.

16. The paper feed tray according to claim 15, wherein an amount of protrusion of the protruding portion in the direction in which the protruding portion abuts on the edge portion of the paper increases downward up to a predetermined position.

17. The paper feed tray according to claim 16, wherein the amount of the protrusion of the protruding portion increases with a first change rate downward up to a predetermined position, wherein the amount of protrusion decreases with a second change rate that is higher than the first change rate downward from the predetermined position, and wherein the amount of protrusion becomes substantially zero when the protruding portion is positioned at a downmost position.

18. The paper feed tray according to claim 11, further comprising a stopper provided in at least one of the guide member and the slide member, the stopper regulating an amount of movement of the guide member with respect to the slide member.

19. An image forming apparatus comprising:

a paper feed tray;

a conveying unit that conveys a paper along a conveying path provided inside a housing of the image forming apparatus; and an image forming unit that is provided in the conveying path to form an image on the paper conveyed by the conveying unit, wherein the paper feed tray includes:

a case that accommodates a stack of paper;

a slide member that is provided to be slidable with respect to the case in accordance with the size of the paper;

a guide member that is supported by the slide member and is provided with a regulation surface regulating an edge portion of the paper; and a movable member that is provided with at least a portion of the regulation surface and is provided to be movable with respect to the slide member, the movable member serving as a portion of the guide member, wherein the movable member is supported to be movable with respect to the slide member so that the regulation surface of the movable member is separated from the edge portion of the paper when setting the paper, wherein the movable member is urged toward a position, where the edge portion of the paper is regulated by contacting the regulation surface of the movable member, and wherein the movable member is structured to be swingable with respect to the slide member such that the movable member is rotatable outside of a position obstructive to a paper setting.

20. An image forming apparatus comprising:

a paper feed tray;

a conveying unit that conveys a paper along a conveying path provided inside a housing of the image forming apparatus; and an image forming unit that is provided in the conveying path to form an image on the paper conveyed by the conveying unit, wherein the paper feed tray includes:

a case that accommodates a stack of paper;

a slide member that is provided to be slidable with respect to the case in accordance with the size of the paper;

a guide member that is supported by the slide member and is provided with a regulation surface regulating an edge portion of the paper; and a movable member that is provided with at least a portion of the regulation surface and is provided to be movable with respect to the slide member, the movable member serving as a portion of the guide member, wherein the paper feed tray further includes a guided member for guiding the movable member to the position where the paper is regulated, wherein the image forming apparatus further comprises a guiding member that abuts with the guided member to guide the movable member to the position, where the paper is regulated by contacting the regulation surface of the movable member when the paper feed tray is accommodated into the image forming apparatus, the guiding member being disposed above the guided member and on a surface that faces with the guided member, and wherein the movable member is structured to be swingable with respect to the slide member such that the movable member is rotatable outside of a position obstructive to a paper setting.

21. The image forming apparatus according to claim 20, wherein the guiding member is a reel-shaped rib that guides the movable member to the position where the paper is regulated.

* * * * *